US007380639B2

(12) United States Patent
Arlasky

(10) Patent No.: US 7,380,639 B2
(45) Date of Patent: Jun. 3, 2008

(54) BACKPRESSURE REDUCING EXHAUST SYSTEM WITH STATIONARY BLADE STRUCTURE

(75) Inventor: Frank Josepn Arlasky, Aliso Viejo, CA (US)

(73) Assignee: Arlasky Performance Inc., Irvine, CA (US)

( * ) Notice: Subject to any disclaimer, the term of this patent is extended or adjusted under 35 U.S.C. 154(b) by 158 days.

(21) Appl. No.: 10/962,923

(22) Filed: Oct. 12, 2004

(65) Prior Publication Data

US 2006/0076185 A1 Apr. 13, 2006

(51) Int. Cl.
*F01N 1/12* (2006.01)

(52) U.S. Cl. ..... 181/279; 181/252; 181/270; 181/280; 181/256; 181/274; 181/212

(58) Field of Classification Search ..... 181/279, 181/256, 274, 252, 270, 280, 264, 212; 123/306, 123/590; 60/324
See application file for complete search history.

(56) References Cited

U.S. PATENT DOCUMENTS

| | | | | | |
|---|---|---|---|---|---|
| 1,816,245 | A * | 7/1931 | Wolford | 181/274 |
| 2,108,671 | A * | 2/1938 | Kihachi | 181/265 |
| 2,359,365 | A * | 10/1944 | Morris | 181/280 |
| 2,646,854 | A * | 7/1953 | Walker | 181/280 |
| 2,841,235 | A * | 7/1958 | Curioni | 181/280 |
| 3,182,748 | A * | 5/1965 | Wirt | 181/280 |
| 4,109,753 | A * | 8/1978 | Lyman | 181/252 |
| 4,303,143 | A * | 12/1981 | Taniguchi | 181/263 |
| 4,331,213 | A * | 5/1982 | Taniguchi | 181/263 |
| 4,339,918 | A * | 7/1982 | Michikawa | 60/316 |
| 4,574,913 | A * | 3/1986 | Fukuda | 181/231 |
| 5,962,822 | A * | 10/1999 | May | 181/264 |
| 6,082,487 | A * | 7/2000 | Angelo et al. | 181/256 |
| 6,158,412 | A * | 12/2000 | Kim | 123/306 |
| 6,745,562 | B2 * | 6/2004 | Berriman et al. | 60/324 |
| 6,796,296 | B2 * | 9/2004 | Kim | 123/590 |
| 2004/0046391 | A1 * | 3/2004 | Vasudeva | 285/368 |
| 2004/0050618 | A1 * | 3/2004 | Marocco | 181/248 |
| 2005/0011697 | A1 * | 1/2005 | Arlasky | 181/225 |
| 2005/0045418 | A1 * | 3/2005 | Choi et al. | 181/270 |

* cited by examiner

*Primary Examiner*—Lincoln Donovan
*Assistant Examiner*—Forrest Phillips
(74) *Attorney, Agent, or Firm*—Martin Faier; James M. Faier; Faier & Faier P.C.

(57) ABSTRACT

The present invention provides an exhaust chamber system, comprising a stationary propeller type blade assembly with a nose cone within or adjacent to an expansion chamber, to create a vortex that swirls exhaust gas towards the outlet. The resultant vacuum within the exhaust chamber aids in scavenging an internal combustion engines exhaust gases, and in reducing system back pressure The exhaust chamber maintains the sound level of the exhaust within acceptable limits, while delivering improved horsepower, torque, and/or fuel efficiency over standard and other performance mufflers.

22 Claims, 2 Drawing Sheets

BACKPRESSURE REDUCING EXHAUST SYSTEM WITH STATIONARY BLADE STRUCTURE

FIELD OF THE INVENTION

The present invention provides an exhaust chamber system for internal combustion engines, which delivers improved horsepower, torque and/or fuel efficiency over standard and other performance mufflers.

BACKGROUND AND DESCRIPTION OF THE RELATED ART

Due to environmental concerns, governmental entities have steadily imposed stricter regulations on the amount and type of exhaust emitted by vehicles powered by the internal combustion engine. Moreover, the amount of noise produced by such engines must also meet stringent standards. The federal and state regulations may improve air quality and decrease noise pollution, however these mandates also produce severe drawbacks because the exhaust emission and sound control devices increase fuel consumption and decrease power production by the affected engines. The exhaust emission and sound control devices hamper engine performance as a result of back pressure of exhaust gas created by the very equipment that muffles the noise and cleans the exhaust gas. Designs of exhaust emission and sound control devices that increase exhaust flow-through will mitigate back pressure on the engine, thereby improving overall engine performance while still meeting demanding governmental environmental standards.

A number of systems have been proposed to provide a more efficient means of reducing noise and/or air pollution from internal combustion engine exhaust. Examples of such proposed systems are found in U.S. patents issued to Kojima (U.S. Pat. No. 4,533,015), Michikawa (U.S. Pat. No. 4,339,918), Taniguchi (U.S. Pat. No. 4,331,213), Harris et al. (U.S. Pat. No. 4,317,502), Taniguchi (U.S. Pat. No. 4,303,143), Kasper (U.S. Pat. No. 4,222,456), Everett (U.S. Pat. No. 4,129,196), Lyman (U.S. Pat. No. (4,109,753), Kashiwara et al (U.S. Pat. No. 4,050,539), and Iapella et al (U.S. Pat. No. 3,016,692), amongst others. However, none of these prior art references facilitate an improvement in engine power output or fuel efficiency. The quest to decrease noise and exhaust emissions, while off-setting the concomitant degradation of engine performance manifested by decreases in fuel efficiency, horsepower, and torque production, proves to be an ongoing struggle.

In particular the system proposed by Lyman (U.S. Pat. No. 4,109,753) presents a muffler assembly for substantially dampening acoustical vibrations of engine exhaust gases. The muffler assembly includes a flow control means, such as a diffuser having a centrally disposed baffle with radially extending deflector vanes and axially extending tabs. The diffuser is positioned near the inlet to an apertured louver tube within a loosely compact shell of sound attenuating material. The apertured louver tube has approximately the same cross sectional area as the inlet and outlet tubes. The diffuser has a planer baffle that substantially blocks and restricts the axial flow of exhaust gases along portions of the longitudinal axis of the louver tube, deflects the flow of exhaust gases toward the sound attenuating material and creates a turbulent flow. However, the Lyman muffler assembly fails to improve engine performance (i.e. fuel efficiency, horsepower, torque), and differs from the present invention in terms of blade (sharp versus rounded) and baffle geometry (planer versus cone shaped), expansion chamber cross sectional area (inlet area same as louver tube versus expansion chamber with larger cross section), and exhaust gas flows (turbulent versus contoured) as will be described.

SUMMARY OF THE INVENTION

The present invention provides an exhaust chamber system, comprising a stationary propeller type blade assembly with a nose cone within or adjacent to an expansion chamber, to contour turbulent exhaust gas and swirl the exhaust gas in a vortex fashion towards the outlet. The nose cone and blade assembly are set at varying angles to aid in arcuately shaping the gas flow. The expansion chamber has a larger cross sectional area than either the inlet or outlet, and is perforated with a maximum aperture count for optimized exhaust gas flow so that the swirling exhaust gas is in communication with the materials in the sound suppression sleeve. The spiral of the swirling exhaust gas becomes progressively tighter as the emissions travel through the expansion chamber to the outlet. This vortex generated by the stationary propeller type blade assembly with a nose cone acts to create a vacuum which draws more gases from the exhaust source, thereby reducing back pressure while increasing the exhaust through put of the engine. The exhaust chamber maintains the sound level of the exhaust within acceptable limits, while delivering improved horsepower, torque and/or fuel efficiency over that of standard and other performance mufflers.

OBJECTS AND ADVANTAGES OF THE INVENTION

It is the object of the present invention to provide a novel exhaust chamber system of the character recited for use with internal combustion engines.

Another object is to provide a novel exhaust chamber system that meets governmental regulations for sound emissions.

Another object is to provide a novel exhaust chamber system that improves fuel efficiency, engine horse power, and torque over internal combustion engines fitted with standard or other performance mufflers.

Another object is to provide a novel exhaust chamber system that contours exhaust gases into a vortex with the use of a stationary propeller type blade assembly with a nose cone.

Another object is to provide a novel exhaust chamber that produces a vacuum that relieves back pressure on the internal combustion engine and aids in scavenging exhaust gas from the system.

Another object is to provide a novel exhaust chamber system made up of a two piece construction.

These and other objects and advantages of the invention will become more apparent as this description proceeds, taken in conjunction with the accompanying drawings.

DETAILED DESCRIPTION OF THE PREFERRED EMBODIMENTS

The invention is described by the following examples. Variations based on the inventive features disclosed herein are within the skill of the ordinary artisan, and the scope of the invention should not be limited by the examples. To properly determine the scope of the invention, an interested party should consider the claims herein, and any equivalent thereof. In addition, all citations herein are incorporated by reference.

Figure 1:
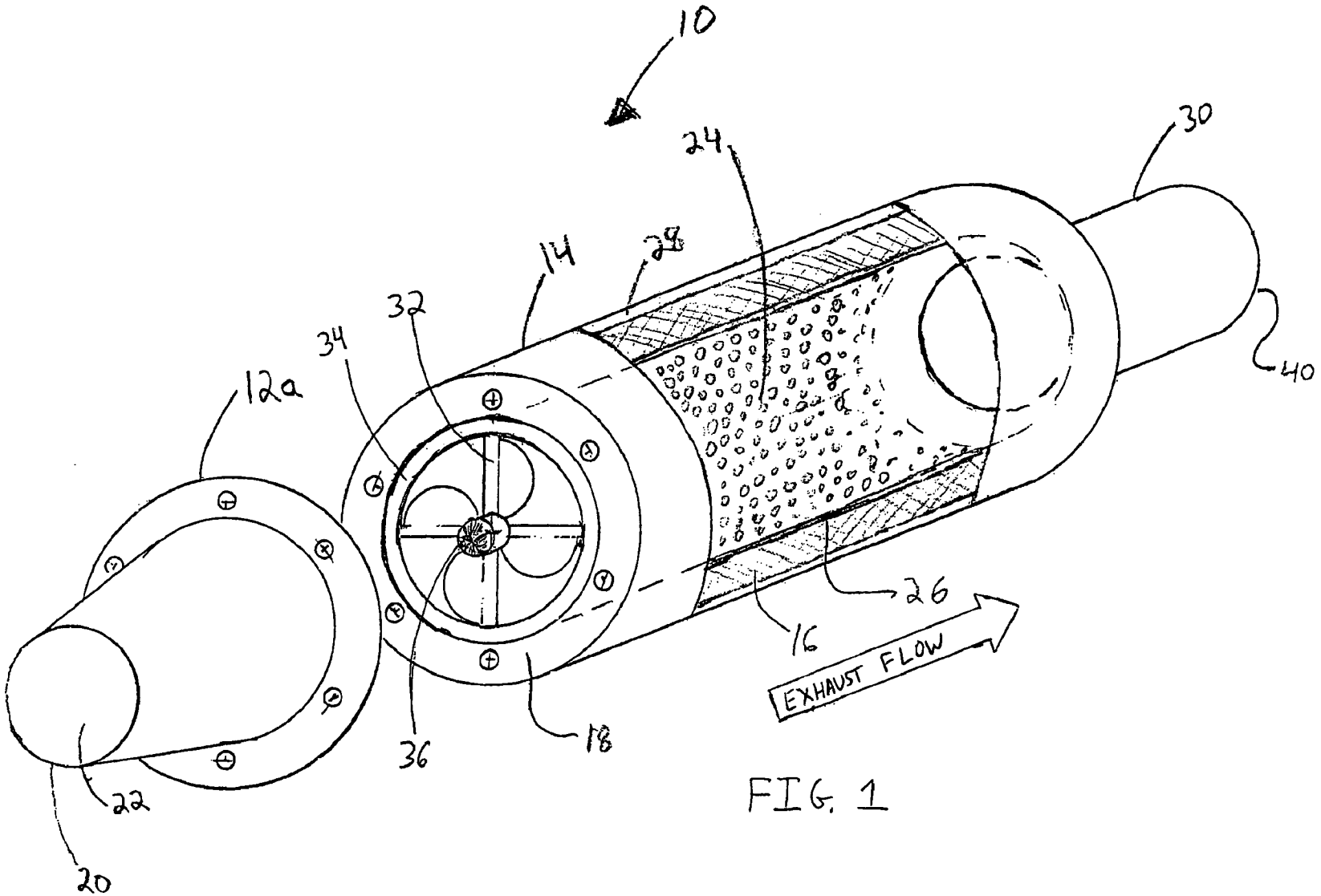
FIG. 1 is an exploded perspective cut away view illustrating the external and internal features of an embodiment of the exhaust chamber system according to the invention.
Figure 2:
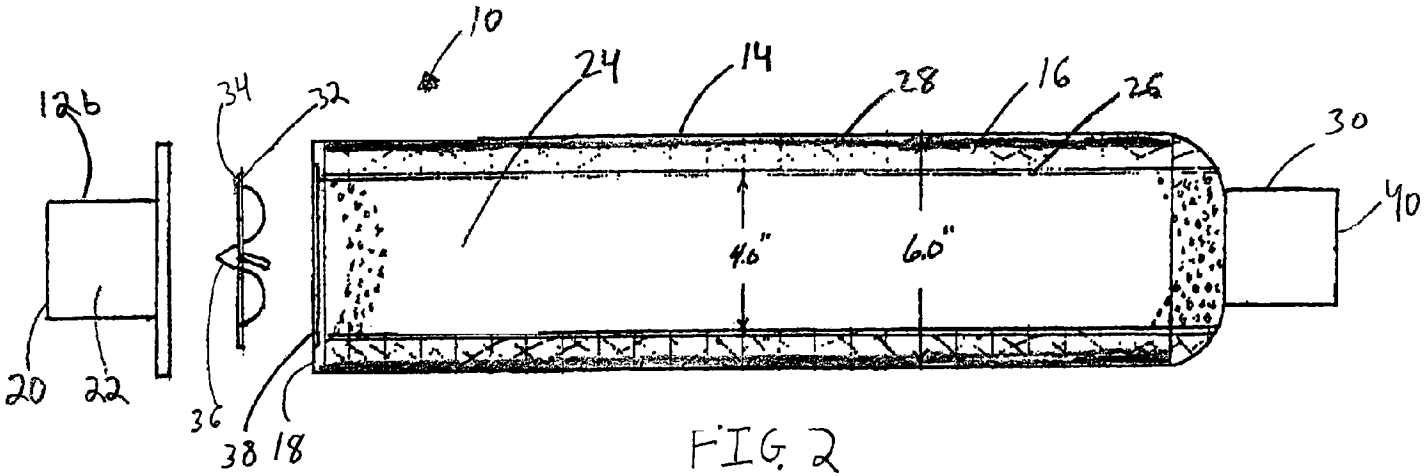
FIG. 2 is an exploded side view of an exhaust chamber system having a stationary propeller type blade assembly embodying the invention.

With reference to the accompanying drawings and particularly FIGS. 1 and 2 an exhaust chamber system 10 is comprised of two major subassemblies an inlet 12 and an exhaust expansion chamber 14. In the embodiment of FIG. 1 a tapered inlet entry end 12*a* is shown, whereas in FIG. 2 a substantially flat inlet end 12*b* and/or outlet end 30 are illustrated. Materials used to form exhaust system components are well-known in the art. In an embodiment, the exhaust chamber system casing and the relevant tubes are made from metals such as 304 stainless steel. Methods of attaching the various components are also well-known. For example, coupling points can be formed integrally, such as welded or brazed.

An inlet tube 12 (either tapered 12*a* in FIG. 1 or flat 12*b* in FIG. 2) is attached to the proximal end flange 18 of the exhaust expansion chamber 14 with a series of bolts, screws or other suitable fasteners. A distal end 20 of inlet tube 12 is attached directly or indirectly to an exhaust gas source, such as an internal combustion engine (not shown). The interior 22 of inlet tube 12 opens up into an expansion chamber 24 defined by the interior of an expansion chamber tube 26. In the case of the tapered inlet tube 12*a*, the interior 22 expands to match the radius of the expansion chamber 24 (FIG. 1). Whereas in the case of the flat inlet tube 12*b* the interior 22 stays constant and has a radius smaller the that of the expansion chamber 24 (FIG. 2). The expansion chamber tube 26 is attached substantially coaxially to outer shell 28 of the exhaust expansion chamber 14. Moreover, expansion chamber tube 26 is attached to outer shell 28 such that the exterior of the expansion chamber tube 26 and the interior of the outer shell 28 combine to define a sound suppression sleeve 16 that surrounds the expansion chamber 24.

Sound suppression sleeve 16 is packed with known sound suppression materials. Examples of such materials include fiberglass, glass wool, ceramic, copper wool, copper strands, steel wool, etc. In the preferred embodiment the sound suppression material is high temperature ceramic packing that holds up to 1800 degrees Fahrenheit and is one inch thick. Expansion chamber tube 26 is perforated stainless steel with maximum aperture count for optimized exhaust gas flow (FIG. 1 cut away) so that the expansion chamber 24 is in communication with the materials in the sound suppression sleeve 16. In the preferred embodiment, tube 26 has about 50% porosity. In another embodiment, tube 26 has between about 40 to about 80% porosity. In the preferred embodiment, expansion chamber 24 has at least about 2.11 times greater flow cross-sectional area than inlet tube 12*b*. In a further least about 2 times greater flow cross-sectional area than inlet tube 12*b*. In yet another embodiment, expansion chamber 24 has between about 2 times to about 2.25 times greater flow cross-sectional area than inlet tube 12*b*.

Figure 3:
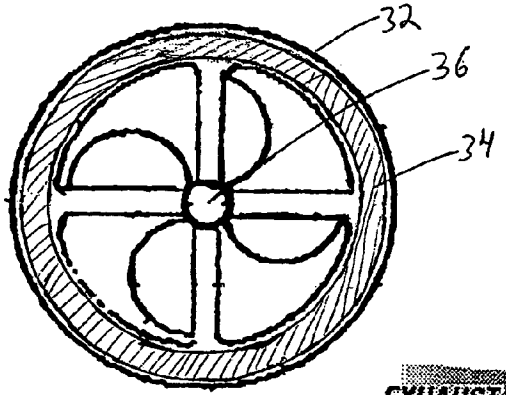
FIG. 3 is an end close-up view of the stationary propeller type blade assembly of an embodiment of the invention.

In the preferred embodiment, at the opening to expansion chamber 24, at an end proximal to inlet tube 12, a stationary propeller type blade assembly 32 with a nose cone 36 and attached high temperature gasket seal 34 (see FIGS. 1, 2 and 3) rests in the recessed counter bore 38 on the face of the proximal end flange 18 of the exhaust expansion chamber 14, and is fully secured by a compression fit when the inlet tube assembly 12 is fastened to the exhaust expansion chamber 14. The use of the tapered inlet tube 12*a* increases the surface area of the gas flow prior to interacting with the blade assembly 32 with the nose cone 36, versus the flat inlet 12*b* whose gas flow area is less then the surface area arc defined by the blade assembly 32 and the expansion chamber 24. The blade assembly 32 is positioned with the nose cone 36 facing the inlet exhaust gas flow. The nose cone 36 is tapered at 45 degrees and is welded to the middle of the stationary propeller type blade assembly 32 that has been formed by water jetting stainless steel and bending the blades to the desired angle. In the preferred embodiment, the propeller comprises four blades with a rounded arcuate shape, each having about a 35 degree spiral twist. Alternatively, the blades have a turn of between about 20-60 degrees. There is no difference in performance if the blades are rotated clockwise or counterclockwise, as long as all blades are consistent with each other. In other embodiments, the propeller can have 2 to 8 blades. In another embodiment the propeller has 3 to 5 blades. In the preferred embodiment, the blades are relatively narrow. However, various blade widths may be utilized in the context of the invention.

Figure 4:
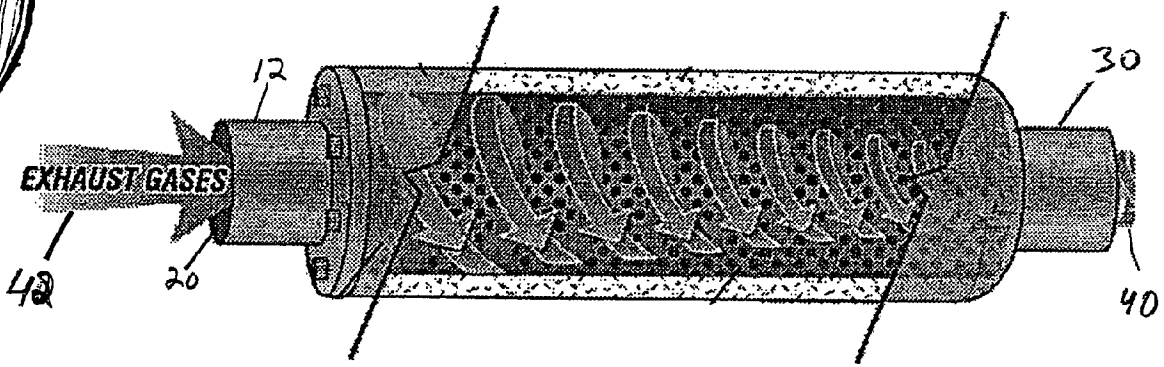
FIG. 4 illustrates the flow of exhaust gas through the exhaust chamber system according to the invention.

In FIG. 4, an arrow 42 at the input 20 of inlet tube 12 represents exhaust gas traveling in a substantially linear direction in that area. When the gas reaches stationary propeller type blade assembly 32 with a nose cone 36, the exhaust gas is forced to spin in a vortex, as it passes through the expansion chamber 24. The swirling effect forces the exhaust towards the tapered outlet tube 30 exit end. The spin-flow of the exhaust gasses is maintained to propel the gas out of the muffler through outlet tube 30 and leads to the atmosphere at distal end 40, either directly or indirectly (e.g. via a tailpipe). The relative difference between the angled shape of airfoil surfaces of the nose cone 36 and the stationary propeller type blade assembly 32 (set at 45 and 35 degrees respectively in the preferred embodiment) assist in contouring the airflow. In an embodiment, outlet tube 30 has substantially the same interior diameter as inlet tube 12*b*. In another embodiment, the inlet tube 12*b* has a substantially smaller interior diameter than outlet tube 30.

Without being limited by any theory, it is believed that as turbulent exhaust gas enters the larger diameter of expansion chamber 24, the gases are contoured and spun by a special set of vanes of the stationary propeller type blade assembly 32 with nose cone 36. The result is a drop in pressure, which aids in scavenging the engine exhaust system. Engine exhaust gas flow velocity is kept high and unwanted back-pressure is reduced. This facilitates the flow of the gasses through the expansion chamber and the outlet tube. The vortex effect creates a vacuum, which draws more gases from the exhaust source, increasing the exhaust throughput of the engine. It is found that the exemplary embodiments of the invention provide high performance propulsion exhaust chambers that increase horsepower, torque, and/or fuel efficiency for internal combustion engines, while maintaining the sound level of the engine within acceptable levels.

Relative to similar standard mufflers that do not have the stationary propeller type blade assembly 32 with a nose cone 36, it has been found that the horsepower of the engine can be increased from 13-19%, and fuel economy was increased by 10-14% in city driving, and from 14-18% in highway driving. Examples of vehicles that would benefit from the exhaust chamber system of the present invention include trucks, automobiles, riding lawn mowers, boats, snowmobiles, etc. Additionally, power machinery, or other equipment driven by internal combustion engines would also achieve performance improvements if equipped with the exhaust chamber system of the present invention.

Having thus described my invention, I claim:

1. An exhaust chamber means for reducing back pressure in the exhaust system of an internal combustion engine comprising:

a shell;

an expansion chamber tube coaxially attached to said shell, where the expansion chamber tube has a substantially constant longitudinal inside diameter free of other structure within said chamber;

an inlet flange tube fastened to said shell in communication with said expansion chamber tube, the inlet flange tube having a smaller flow cross-sectional area than the expansion chamber tube; and a stationary blade assembly arranged in said inlet flange or in said tube, the blade assembly including a nose cone and from 2 to 8 blades, the blades having a turn of between about 20-60 degrees.

2. The exhaust chamber of claim 1, wherein the blade assembly is compressed fit between said inlet flange tube and said expansion chamber, and the blade assembly rests in a counter bore groove in said inlet flange tube.

3. The exhaust chamber of claim 1, wherein the nose cone has a taper substantially of about 45 degrees.

4. The exhaust chamber of claim 1, wherein the blades of the blade assembly are arranged substantially at about 35 degrees to the path of combustion gases.

5. The exhaust chamber of claim 1, wherein the shell includes sound suppression materials residing in the coaxial space between the shell and the expansion chamber tube, the sound suppression material selected from the group consisting of fiberglass, glass wool, copper wool, copper strands, steel wool, high temperature ceramic, and a combination thereof.

6. The exhaust chamber of claim 1, wherein the expansion chamber tube has between about 2 to 2.25 times greater flow cross-sectional area than the inlet flange tube.

7. The exhaust chamber of claim 1, wherein the inlet flange tube has conical shape that expands to match the cross sectional area of the expansion chamber tube.

8. The exhaust chamber of claim 1, wherein said expansion chamber tube is perforated with apertures to achieve porosity.

9. The exhaust chamber of claim 1, wherein the exhaust chamber is joined to an internal combustion engine through a series of manifolds, pipes, tubing or other emission control devices.

10. The exhaust chamber of claim 1 having 3-5 blades.

11. The exhaust chamber of claim 1, where the blades extend from the nose cone to the inside surface of the expansion chamber tube.

12. A method of accelerating internal combustion engine exhaust gases for reducing back pressure in an exhaust system of an internal combustion engine, comprising:

flowing combustion gases from an internal combustion engine to an inlet of an exhaust chamber, said chamber being free of other structure within said chamber and from 2 to 2.25 times the cross section of said inlet;

flowing the gases from the inlet past a blade assembly including a nose cone and from 2 to 8 blades, each blade having a turn of between about 20-60 degrees;

accelerating the gases from the nose cone to the peripheral portions of the blades into an expansion chamber, the expansion chamber having a substantially constant longitudinal inside diameter and a larger cross-sectional area than the inlet; and forming an area of lower pressure within a central area of the expansion chamber, the area of lower pressure reducing back pressure in the exhaust system of the internal combustion engine inducing a vortex swirling of a gas stream from said blade assembly to an outlet from said chamber.

13. The method of claim 12, where the gases become progressively lighter from the inlet of the expansion chamber to said outlet of the expansion chamber.

14. The method of claim 12, where the nose cone has a taper substantially of about 45 degrees and the blades each has a turn of about 35 degrees.

15. The method of claim 12, where the expansion chamber has between about 2 to 2.25 times greater cross-sectional area than the inlet.

16. The method of claim 12, where the inlet has a tapered conical shape that expands to match the cross-sectional area of the expansion chamber.

17. The method of claim 12, further comprising reducing the back pressure in an exhaust system of an internal combustion engine.

18. An exhaust chamber means for reducing back pressure in the exhaust system of an internal combustion engine, the means comprising:

a shell;

an expansion chamber coaxially attached to the shell, where the expansion chamber has a substantially constant longitudinal inside diameter;

an inlet means for providing a small flow cross-sectional area than the expansion chamber, the inlet means fastened to the shall and in flow communication with the expansion chamber;

an outlet means fastened to said expansion chamber at an end opposed to said inlet means for exiting gases from said expansion chamber; and a stationary blade assembly means at the entrance to the expansion chamber, the stationary blade assembly including a nose cone and from 2 to 8 blades each having a turn of between about 20 and 60 degrees arranged substantially at about 35-45 degrees to the path of combustion gases for reducing the back pressure in the exhaust system of the internal combustion engine and to induce a vortex swirling of a gas stream from said blade assembly to said outlet means.

19. The exhaust chamber means of claim 18, where the expansion chamber has between about 2 to 2.25 times greater cross-section area than the inlet means.

20. The exhaust chamber means of claim 18, where the inlet means has a tapered conical shape that expands to match die cross-sectional area of the expansion chamber.

21. The exhaust chamber means of claim 18, where the stationary blade assembly means includes from 3 to 5 blades.

22. The exhaust chamber means of claim 21 where the blades each have a turn of about 35 degrees.

* * * * *